United States Patent [19]

Noren

[11] Patent Number: 4,676,365

[45] Date of Patent: Jun. 30, 1987

[54] MOTOR DRIVEN ENDLESS TRAY ACCUMULATOR

[75] Inventor: Tore H. Noren, Petaluma, Calif.

[73] Assignee: The Stero Company

[21] Appl. No.: 202,456

[22] Filed: Oct. 31, 1980

Related U.S. Application Data

[62] Division of Ser. No. 62,293, Jul. 31, 1979, Pat. No. 4,274,886.

[51] Int. Cl.[4] ..... B65G 29/00

[52] U.S. Cl. ..... 198/803.14; 134/62; 134/133

[58] Field of Search ..... 198/646, 795, 796, 803.14; 134/62, 63, 126, 131, 133, 134; 211/126

[56] References Cited

U.S. PATENT DOCUMENTS

| | | | |
|---|---|---|---|
| 3,550,755 | 12/1970 | Noren | 198/795 |
| 3,698,407 | 10/1972 | Noren | 134/70 X |
| 3,967,734 | 7/1976 | Morgan et al. | 211/126 |

*Primary Examiner*—Douglas D. Watts

*Attorney, Agent, or Firm*—Alvin E. Hendricson

[57] ABSTRACT

An endless train of dollies with means for continuously moving them in an oval path and in either direction, each dolly supporting a tray rack that in turn can removably support a plurality of trays in stacked relation. Bus boys load trays of soiled dishes into the tray racks at one station in the endless train of moving dollies. The endless train of moving dollies is positioned adjacent to a second endless train of moving dollies, each dolly in this second train supporting a basket for receiving soiled dishware and trays that a second bus boy standing in a second station positioned between the two endless trains of dollies transfers trays of soiled dishware with their trays from the tray racks to the baskets in the second endless conveyor. The tray racks are of novel construction and each one consists of a U-shaped casing in horizontal cross section. The two parallel walls of the casing have tray supporting rods on their inner surfaces and the rods of both walls are arranged in pairs so that each pair can support a removable tray on which soiled dishware has been placed. The height between adjacent pair of tray supporting rods is such that the dishware on one tray will not interfere with the tray thereabove.

2 Claims, 6 Drawing Figures

MOTOR DRIVEN ENDLESS TRAY ACCUMULATOR

This is a division of application Ser. No. 62,293, filed July 31, 1979, now U.S. Pat. No. 4,274,886.

CROSS REFERENCES TO RELATED PATENTS

In my U.S. Pat. No. 3,447,491, issued June 3, 1969, on a sectional oval-shaped table for endless conveyor for dishwasher, I disclose a plurality of table sections that may be interconnected for forming an oval table of a desired length and width. The sections are small enough to be moved through doorways and then assembled.

Then in my U.S. Pat. No, 3,538,999, issued Nov. 10, 1970, I show an oval-shaped endless track for supporting a train of dollies that in turn carry dish-containing baskets. The dollies form an endless train and abut each other. Novel means is used for successively moving one dolly at a time which causes all of the dollies to move in unison. The dollies are moved through a dishwasher that washes, rinses and sterilizes the dishes.

A third patent of mine is numbered U.S. Pat. No. 3,550,755, and was granted Dec. 29, 1970, on an endless conveyor for a dishwasher with links interconnecting adjacent dollies to form an endless dolly train. Certain of these links are adjustable as to length and in this way the overall length of the endless dolly train can be adjusted to conform to the overall length of the oval table.

BACKGROUND OF THE INVENTION

Field of the Invention. The present practice of restaurants in handling soiled dishes is to place them on trays and then put the trays on endless belt conveyors that carry the trays to the area where the dishes are washed in a commercial dishwasher. Frequently, the foreign matter on the dirty dishes will drain onto the belt conveyor and will cause the belt to give off an unpleasant odor unless time is taken to frequently wash the conveyor belt.

In my present invention I provide a motor driven endless tray accumulator in which a plurality of tray receiving racks are used and each rack is supported by a dolly frame. These dolly frames have wheels that ride in an endless oval track and adjacent dolly frames are interconnected and are moved so that the entire endless train of dolly frames with their tray supporting racks are continuously moved along the oval track.

Each tray rack has means for removably supporting trays of soiled dishes and a portion of the track is disposed adjacent to a second oval track that supports a train of dollies. The trays of soiled dishes are removed from the tray racks that are moving adjacent to the second oval track and the soiled dishes are placed in dish-carrying baskets supported by the dollies on this oval track where they are conveyed through a commercial dishwasher for washing, rinsing and sterilizing the dishes. If the operator is unable to unload all of the trays in a tray rack and transfer the soiled dishes to the dish-carrying baskets supported by the dollies, the accumulator will again carry the excess trays in their tray racks around the oval track and present the trays with the soiled dishes a second time to the operator for their removal from the racks and the transference of the dishes to the second oval track that supports the dish-carrying baskets. The basic invention is the continuous moving of an endless train of tray racks, each rack containing a plurality of removable trays with their soiled dishware and the individual removal of these trays by a bus boy who transfers the trays and soiled dishware to an adjacent conveyor with dishware receiving baskets, these baskets conveying the dishware and trays to a dishwasher. If the bus boy is unable to remove all of the trays of soiled dishware from a tray rack as it passes his position, the leftover trays and dishware will be moved around the endless train track a second time and past the same bus boy where he will be able to remove the remaining trays and dishes and transfer them to the baskets that carry the dishware and trays to the dishwasher.

SUMMARY OF THE INVENTION

An object of my invention is to provide a motor driven endless tray accumulator in which an endless train of soiled dish-receiving racks are supported by dollies that are continuously moved along an oval rack. Each rack is mounted on a dolly and removably receives a plurality of trays with their soiled dishes from an operator and another operator removes the trays of soiled dishes from the racks that are moving adjacent to a second oval track on which an endless train of dollies with their baskets are moving and places the soiled dishes and racks in the baskets where they are conveyed through a dishwasher that washes, rinses and sterilizes the dishes. Should the second operator not have sufficient time to remove all of the trays with their soiled dishes from a rack on the accumulator as it moves past the second operator, the accumulator will carry the excess racks around the oval track a second time to permit the operator to remove these racks with their soiled dishes and transfer them to the dish-carrying baskets of the second endless track.

A further object of my invention is to provide a special type of tray rack for the accumulator. This tray rack is supported by a dolly and comprises a U-shaped casing in horizontal section with a web portion extending between parallel vertical side walls. These side walls have horizontal bars on their inner surfaces, the bars on the two walls being arranged in pairs for removably supporting trays carrying soiled dishware. The vertical distance between adjacent sets of bars provides sufficient clearance for the dishware carried by the trays when the trays rest on the bars so that the dishware on one tray will not strike the tray positioned thereabove.

DESCRIPTION OF THE PREFERRED EMBODIMENT

Figure 1:
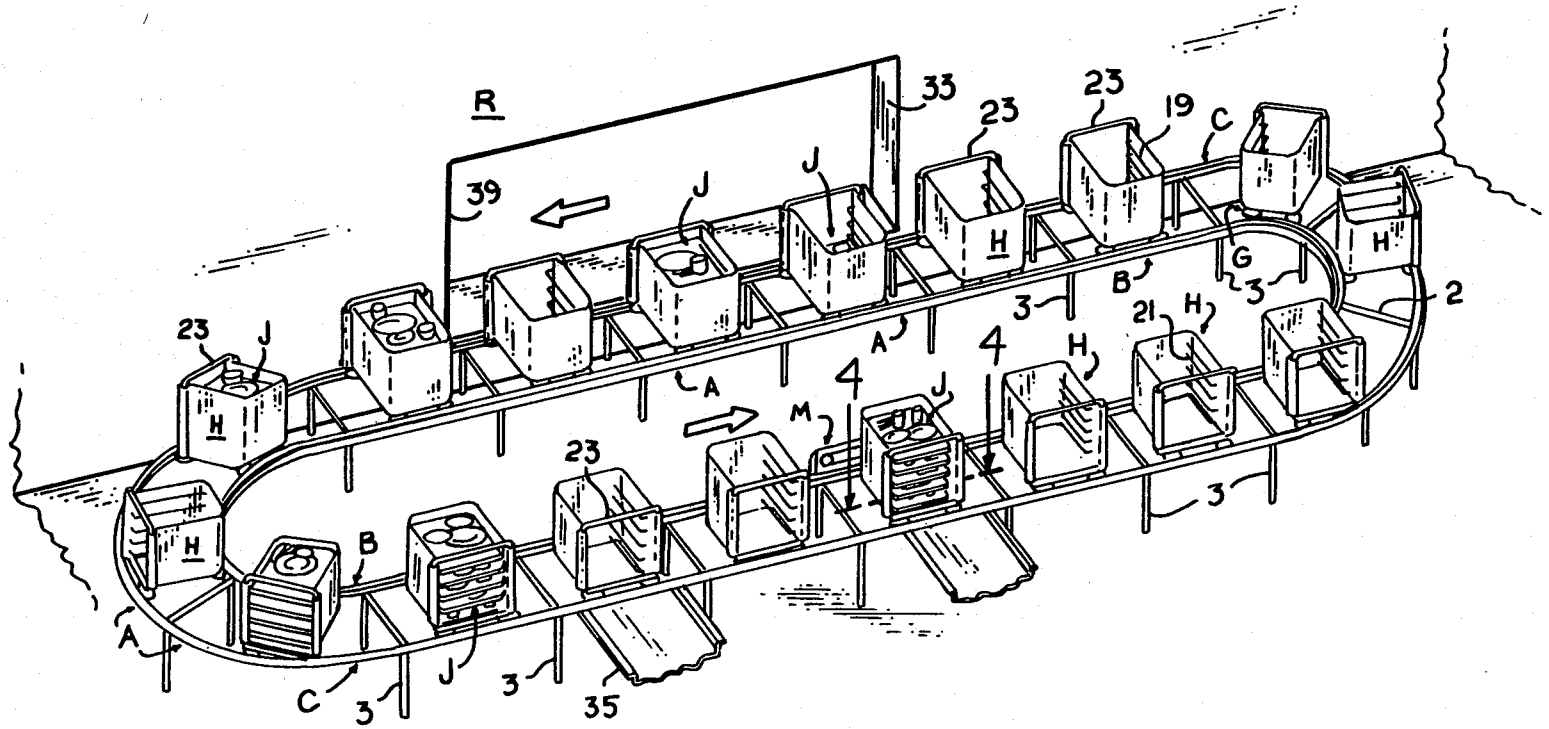
FIG. 1 is a perspective view of my motor driven endless tray accumulator.

In carrying out my invention, I provide an oval-shaped endless track that is made up from a plurality of units A, connected together, see FIG. 1. Some of the units are straight while others are curved and the oval-shaped endless track can be of any length desired by using as many units as is necessary to produce the final result. Each unit is small enough to be movable through a door opening and then these units can be assembled and connected to each other to form the endless oval track.

Figure 3:
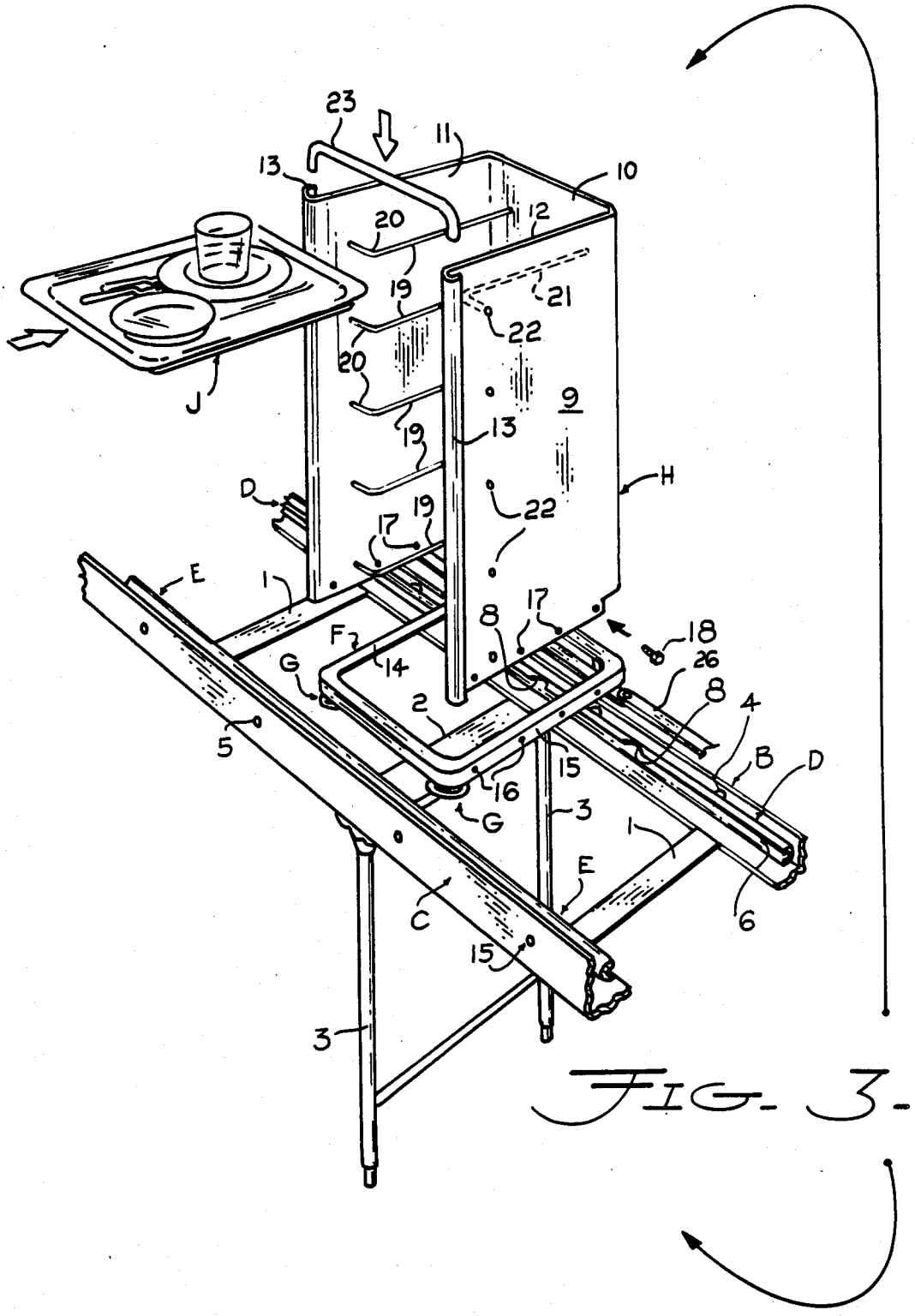
FIG. 3 is an enlarged exploded view of a portion of the endless track showing one dolly and its rack with means for removably supporting a plurality of trays with their soiled dishes.

An enlarged perspective view of a portion of the oval track is shown in FIG. 3. The frame is composed of a pair of angle irons B and C, that are spaced apart and parallel each other. Cross pieces 1 interconnect the two angle irons and the frame, composed of the angle irons and cross pieces, is supported by transverse members 2 which in turn rest on legs 3. The angle irons B and C, are in straight lengths and curved portions so as to form an oval-shaped runway when they are connected together as illustrated in FIG. 1.

Figure 4:
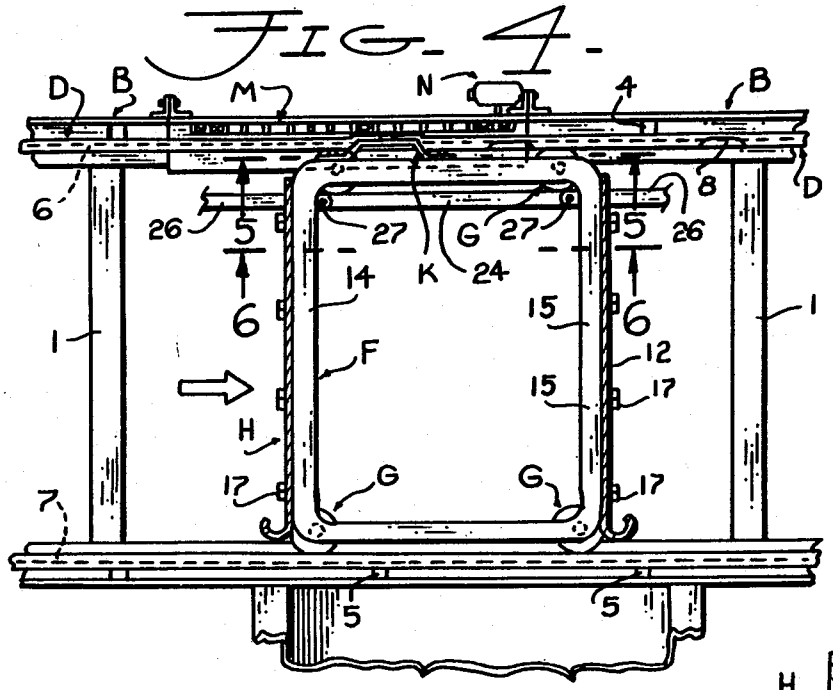
FIG. 4 is an enlarged horizontal section taken along the line 4—4 of FIG. 1 and illustrates the drive mechanism for moving the endless train of racks with their supporting dollies along the oval track of the accumulator.

Referring again to FIG. 3, it will be noted that the angle iron B, supports a rail D. The structure for connecting the rail D to the angle iron B, is shown in detail in FIG. 5 of my U.S. Pat. No. 3,538,999; and in FIG. 12 of my U.S. Pat. No. 3,550,755. FIG. 4 of my present drawings show the angle iron B, having members 4 connected to the angle iron B, and to the rail D for supporting the latter in spaced relation to the angle iron. What I have described for connecting the rail D to the angle iron B, also holds true for connecting the outer rail E to the angle iron C. The connections between the rail E and angle iron C, are indicated at 5 and are similar to the connections 4, see FIG. 3. Each rail D and E, is made from tubular material which is collapsed along its inner edge to form a groove 6 in the rail D, and a groove 7 in the rail E. The grooves 6 and 7 face each other throughout the entire oval track and will support the wheels on dollies F, and permit the dollies to move along the oval track.

Figure 5:
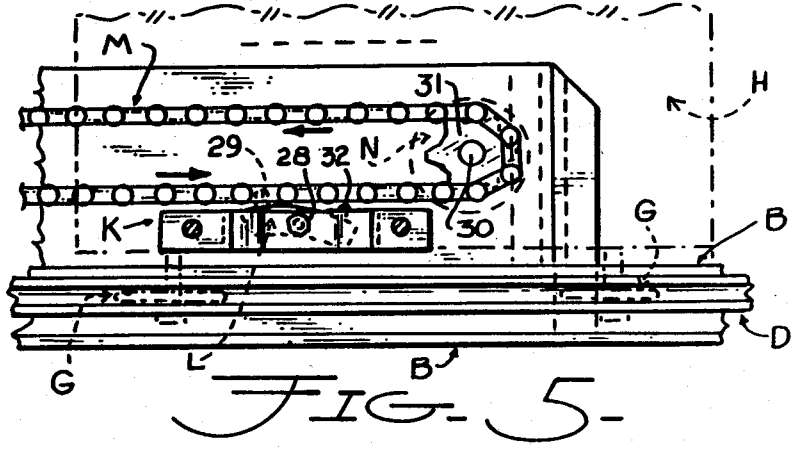
FIG. 5 is an enlarged vertical section taken along the line 5—5 of FIG. 4, and shows a portion of the drive mechanism for moving the train of dollies along the oval track of the accumulator.

One of the dollies F, is shown in FIGS. 3 and 4 and it consists of a rectangular frame with four wheels G mounted at the four corners of the frame and being rotatable about vertical axes. The type of wheel used is the same as shown in FIG. 5 of my U.S. Pat. No. 3,538,999. Two of the wheels ride in the groove 6 in the rail D while the other two wheels travel along the groove 7 in the rail E. FIG. 3 of the present drawings show the track D with a pair of spaced apart recesses 8 in its upper edge, the distance between these two recesses being the same as the distance between the two wheels G, of the dolly that are received in the track D. The operator can mount a dolly F, on the rails D and E by first placing two of the wheels G into the groove 7 of the rail E and then aligning the other two wheels G above the recesses 8 in the rail D and then lowering the end of the frame carrying these wheels for passing the wheels through the recesses and onto the track D. The dollie frame F, is now free to be moved along the oval track.

Before describing how the adjacent dollies F, in a train of dollies are interconnected and how the entire endless train of dollies are moved, I will first describe the tray rack H that is mounted on each dolly. The tray rack has a casing 9 that is U-shaped in horizontal cross section, see FIG. 3. The web portion 10 of the casing 9 is positioned to face the inner side of the oval track while the two side walls 11 and 12 of the casing 9 extend toward the outer side of the track and their vertical edges are formed into a partial cylindrical roll at 13.

The U-shaped casing 9 has the width of its web portion 10 equal to the width of the dolly frame F, and has the widths of the two side walls 11 and 12 equal to the lengths of the sides of the dolly frame F, see FIG. 3. Note that the two sides 14 and 15 of the dolly frame F, have spaced apart threaded bores 16 and the side walls 11 and 12 of the casing 9 have openings 17 which may be aligned with the bores 16 when the casing is mounted on the dolly frame. Cap screws 18 are inserted in the holes 17 and are threaded into the bores 16 for securing the casing 9 to the dolly F, see also FIG. 4.

The U-shaped casing 9 has means for removably supporting a plurality of trays J, see FIG. 3. The casing wall 11 has a plurality of L-shaped bars 19. The ends 20 of the bars 19 are secured to the inner surface of the casing wall 11 while the other ends of the same bars are secured to the wall 10 of the casing. The bars 19 are spaced one above the other in parallel arrangement and I have shown five bars for supporting five trays although I do not wish to be confined to any particular number of bars.

In like manner, the side wall 12 of the tray rack casing 9 supports a plurality of L-shaped bars 21, (see the dotted lines in FIG. 3), and their ends 22 are secured to the casing wall 12 while their other ends are secured to the casing wall 10. The pairs of bars 19 and 21 are arranged in horizontal planes that are spaced apart so that the trays J of soiled dishes will be removably supported by the pairs of bars and there will be sufficient vertical spacing between adjacent trays for them to support the various items on the tray. A cross bar 23 has turned down ends that are received in the tops of the cylindrical edges 13 of the casing side walls 11 and 12 to hold the upper end of the casing in a fixed position. FIG. 3 shows a tray J of soiled dishes ready to be inserted into the rack casing H, and supported by the top pair of L-shaped bars 19 and 21.

Figure 2:
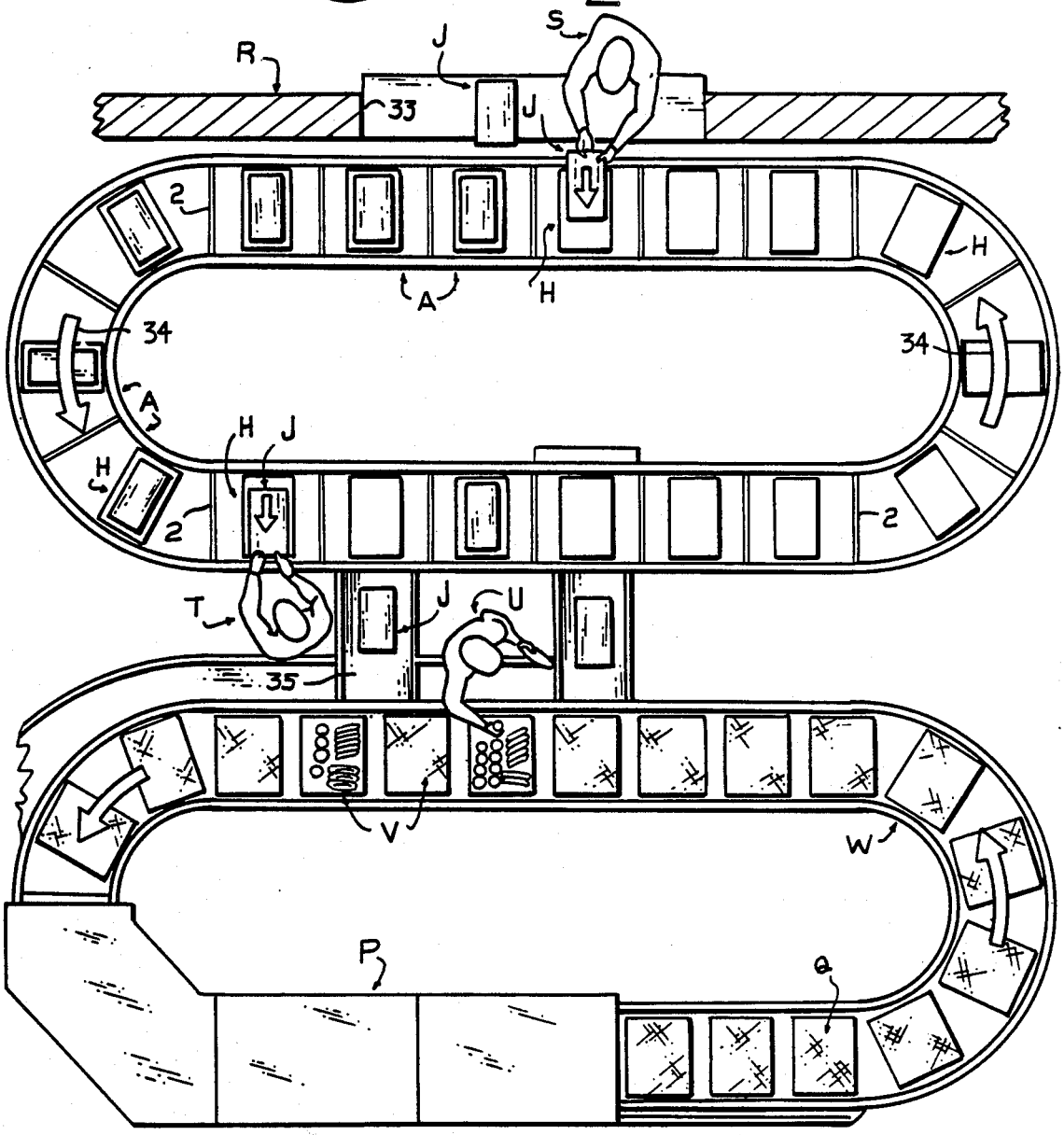
FIG. 2 is a top plan schematic view of my tray accumulator when shown in relation to my oval-shaped endless conveyor for dish-carrying baskets and dollies where an operator can transfer trays of soiled dishes from the racks on the accumulator and transfer them to the baskets on the second endless conveyor where the soiled dishes and racks are moved through a dishwasher for washing, rinsing and sterilizing them.
Figure 6:
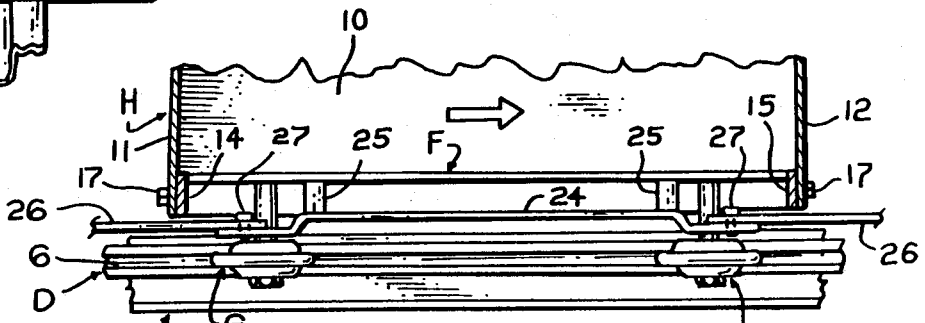
FIG. 6 is an enlarged vertical section taken along the line 6—6 of FIG. 4, and illustrates how the dolly supporting wheels ride along the oval track.

It will be seen from FIGS. 1 and 2 that a number of racks H, are provided, one for each dolly F, and that each rack removably supports a pluality of trays J. I will now describe the mechanism for interconnecting the dollies F to form an endless train of dollies and then describe the means for moving the dolly train in one direction or the other. Referring to FIGS. 4 and 6, I show the dolly F, supporting a bar 24 which is secured to the dolly by members 25. Each dolly is thus equipped and links 26 are pivotally connected to the ends of the bars on one dolly and to the ends of bars on adjacent dollies at 27 for interconnecting adjacent dollies so as to complete the entire endless train of dollies.

The means for continuously moving the train of dollies in either direction is illustrated in FIGS. 4 and 5. A bracket K, is shown in FIG. 4 as being secured to the dolly F, while FIG. 5 shows an enlarged view of the bracket K, and shows it pivotally supporting a pawl L, at 28. The pawl L, is counter weighted so that the right hand end of the pawl when looking at FIG. 5, has the tendency to swing downwardly about the pivot 28. The left hand end of the pawl has an integral upwardly extending pin 29 designed to enter a link in an endless drive chain M, shown in FIGS. 4 and 5 in the lower reach of the chain that is being moved to the right in FIG. 5 and likewise moving the pawl L, bracket K, and dolly F to the right.

The schematic view of FIG. 1, shows a portion of the endless drive chain M, and FIG. 4 shows an electric motor N, supported by the angle iron B, and haivng a shaft 30 on which a sprocket 31 is mounted and connected to the endless chain M for moving it in the direction indicated by the arrows in FIG. 5. The weighted pawl L, also has an integral upstanding pin 32, at the right hand portion of the pawl and this normal weighted portion of the pawl will keep the pin 32 out of contact with the adjacent link in the endless chain M. Should the operator wish to advance the dollies F more rapidly than the speed of the lower reach on the chain M, this movement would advance the pawl L, more rapidly and disengage the pin 29 from its associate chain link. However, before this could happen, the swinging of the pawl L about is pivot 28 to disengage the pin 29 from the chain would cause the right hand end of the pawl to swing upwardly and move the right hand pin 32 into engagement with the chain before the pin 29 was entirely freed from its chain. Therefore, it is impossible to entirely disconnect the pawl L from the chain M, and at no time can the train of dollies F be moved faster than the speed of the lower reach of the endless chain.

FIG. 2 is a top schematic plan view of my endless tray accumulator shown in relation to a commercial dishwasher P with its endless train of dish racks Q. The particular construction of the dishwasher P, and the train of racks Q have been shown and claimed in a number of my patents and they form no part of my present invention except insofar as they cooperate with my endless tray accumulator. FIG. 2 further shows a wall R with a "pass through" opening 33 in it. A bus boy S, is shown moving a tray J of soiled dished through the wall opening 33 and placing the tray in one of the adjacent tray racks H. Arrows 34 indicate that the accumulator train of racks is moving in a counterclockwise direction when looking at FIG. 2, although the rack train could be caused to move in a clockwise direction. Since the train of racks is constantly on the move, the bus boy S can keep loading the racks with one or more trays of soiled dishes as these racks move past the "pass through" opening 33 in the wall R.

FIG. 2 further shows another bus boy T removing trays of soiled dishes from the adjacent moving rack H, and placing them on a "pass over" 35 where still another bus boy U can remove the soiled dishes from the tray and place them in the dish racks V, in an endless train of dish racks carried by dollies on an oval track W. The soiled tray J is also placed in the adjacent dish rack V, and the continuously moving train of dish racks will move the dishes and trays through the commercial dishwasher P, consisting of the usual dishwashing, rinsing and sterilizing compartments.

I claim:

1. A tray accumulator system for removing a large volume of trays containing dishes, flatware and the like from a cafeteria or the like for cleansing of the trays and contents comprising:

an elongated endless track extending through a tray repository station and a spaced tray removal station;

a plurality of tray racks disposed in succession about said track and being movable together thereabout;

each of said racks having a plurality of vertically spaced tray retaining means for carrying a plurality of trays and contents, and each of said racks having drive engaging means;

drive means disposed to engage the drive engaging means of each of said racks in succession to continuously move said plurality of racks about said track at a rate sufficient to remove trays from said receiving station at the rate they are received; and an endless belt dishwasher having a loading station disposed adjacent said tray removal station for transfer of trays and wares thereon to the dishwasher at a predetermined rate that is less than the maximum carrying capacity of said plurality of tray racks whereby said tray racks are adapted to recirculate some trays and contents about said endless track.

2. A tray accumulator system for removing a large volume of trays containing dishes, flatware and the like from a cafeteria or the like for cleansing of the trays and contents comprising:

an elongated endless track extending through a tray repository station and a spaced tray removal station;

a plurality of tray racks disposed in succession about said track and being movable together thereabout;

each of said tray racks being comprised as a wheeled dolly mounted on said endless track to roll thereabout and an attached upright structure having an integral back wall and parallel side walls spaced apart a distance slightly greater than a tray width, the front vertical edges of said side walls being rolled outwardly with a U-shaped reinforcing bar extending across the top of the open front of the rack with ends depending into the rolled side edge, and pairs of tray supporting members disposed in vertically spaced relation on said side walls for receiving and retaining trays and contents disposed in said racks; and drive means disposed to engage the drive engaging means of each of said racks in succession to continuously move said plurality of racks about said track at a rate sufficient to remove trays from said receiving station at the rate they are received.

* * * * *